US007086103B2

(12) United States Patent
Barthelt

(10) Patent No.: US 7,086,103 B2
(45) Date of Patent: Aug. 8, 2006

(54) ROTATING BED WITH IMPROVED STABILITY

(76) Inventor: Hans-Peter Barthelt, Hegensberger Str. 132, Esslingen (DE) D-73732

( * ) Notice: Subject to any disclaimer, the term of this patent is extended or adjusted under 35 U.S.C. 154(b) by 50 days.

(21) Appl. No.: 10/500,775

(22) PCT Filed: Dec. 19, 2002

(86) PCT No.: PCT/DE02/04661

§ 371 (c)(1),
(2), (4) Date: Jul. 6, 2004

(87) PCT Pub. No.: WO03/057125

PCT Pub. Date: Jul. 17, 2003

(65) Prior Publication Data

US 2005/0102754 A1 May 19, 2005

(30) Foreign Application Priority Data

Jan. 8, 2002 (DE) ..... 102 00 408

(51) Int. Cl.
*A61G 7/16* (2006.01)

(52) U.S. Cl. ..... 5/613; 5/612; 5/424; 5/81.1 R

(58) Field of Classification Search ..... 5/612, 5/613, 81.1 R, 83.1, 86.1, 87.1, 424
See application file for complete search history.

(56) References Cited

U.S. PATENT DOCUMENTS

| | | | | |
|---|---|---|---|---|
| 3,239,853 | A * | 3/1966 | Macdonald | 5/616 |
| 4,183,109 | A * | 1/1980 | Howell | 5/618 |
| 4,999,862 | A | 3/1991 | Hefty | |
| 5,022,810 | A * | 6/1991 | Sherrow et al. | 414/501 |
| 5,095,561 | A * | 3/1992 | Green et al. | 5/618 |
| 5,390,380 | A * | 2/1995 | James-Wallace | 5/84.1 |
| 5,444,883 | A * | 8/1995 | Iura | 5/618 |

FOREIGN PATENT DOCUMENTS

| | | |
|---|---|---|
| DE | 20101557 U1 | 8/2001 |
| WO | WO 00/51830 | 9/2000 |

* cited by examiner

*Primary Examiner*—Michael Trettel
(74) *Attorney, Agent, or Firm*—Leydig, Voit & Mayer, Ltd.

(57) ABSTRACT

A rotating bed is provided that has a base with a mattress frame supported for rotation about a vertical axis. The mattress frame is divided into sections and can be converted into a chair-like configuration in one rotational position. In order to increase the stability of the arrangement in the chair position, at least one support leg is provided that either contacts the floor from the beginning or only makes contact with the floor when the stability limit without the support leg is exceeded.

33 Claims, 7 Drawing Sheets

ROTATING BED WITH IMPROVED STABILITY

FIELD OF THE INVENTION

The present invention relates generally to sleeping beds, and more particularly, to a sleeping bed that can be automatically converted from a normal sleeping position into a chair position.

BACKGROUND OF THE INVENTION

A rotating bed known from DE 199 12 937 has a height-adjustable base. The base stands freely in a conventional bed frame. A rotary joint arranged on the base serves to connect the base to a bed or mattress frame. The bed or mattress frame is frequently divided into four sections, viewed in the longitudinal direction of the bed, namely a back part or back section, a central section, a thigh section, and a lower leg section.

The central section is directly connected to the base by means of the rotary joint, the axis of which extends vertically. The back section is coupled to the central section by means of a hinge arrangement with a horizontal axis, and a thigh section is similarly connected to the central section on the opposite end. The lower leg section is coupled to the free end of the thigh section by means of a hinge arrangement with a horizontal axis.

In order to enhance stability, the base has relatively large dimensions in the longitudinal direction of the bed. However, it cannot project beyond the structure of the bed frame in the lateral direction.

In the normal bed or sleeping position, the bed frame is essentially flat and its longitudinal axis extends parallel to the longitudinal axis of the floor coverage area defined by the contact points between the base and the floor.

In order to transfer a person lying in the bed into a sitting position, the back section is initially raised into an approximately 80° position with the aid of a motor. The thigh section and the lower leg section also are moved into a slightly raised position in order to provide the user with a sense of stability during the subsequent rotation.

After the bed frame is moved into this position, it is turned on the base by approximately 90° until the thigh section and the lower leg section transversely extend over the side of the bed. The term side of the bed refers to the conventional definition or meaning.

As soon as the bed frame is transversely aligned in this fashion, the thigh section and the lower leg section are lowered, wherein the lower leg section is lowered to such a degree that it essentially extends vertically. The bed frame now has a chair-like configuration, in which the free end of the lower leg section is practically in contact with the floor.

At this time, the front edge of the seat projects significantly beyond the side of the floor coverage area of the base. This arrangement may approach its stability limit, particularly when the bed frame is raised, depending on the weight of the user, the distance by which the user leans forward over the seat edge in the chair position, the weight of the base, the size of the floor coverage area of the base and any impermissible manipulations the patient during the rotation. If the stability limit is exceeded, the bed could completely tip over on the side concerned, and the user can be trapped underneath the bed.

OBJECTS AND SUMMARY OF THE INVENTION

It is an object of the invention to provide a rotatable bed that has improved stability when in a rotated position which prevents tipping over.

The rotating bed of the invention has a base that stands on the floor with contact points between the base and the floor defining a floor coverage area. The floor coverage area typically is rectangular. The longer sides of the rectangle extend parallel to the longitudinal direction of the bed. The bed frame arrangement is mounted on the base with the aid of a rotary joint such that the bed frame can rotate relative to the base by at least 90° about a vertical axis of rotation. In the normal bed or sleeping position, the longitudinal axis of the bed frame is aligned parallel to the longitudinal axis of the floor coverage area, with these axes extending perpendicular to one another when in the chair position.

In order to increase the stability, at least one additional support leg is provided on the base. This additional support leg projects from the floor coverage area in a direction that essentially extends perpendicular to the longitudinal direction of the rotating bed in the normal bed or sleeping position. The additional support leg increases the floor coverage area in comparison to the floor coverage area of a base without an additional support leg in the direction in which the bed frame projects in the chair position. Depending on the particular embodiment, the floor coverage area of the base may be defined by rails or bars, rigid legs or rotatably mounted wheels.

The utilization of at least one additional support leg is particularly advantageous in connection with steerable wheels. Depending on the caster of the steerable wheels, the width of the floor coverage area may vary by up to 10 cm according to the steering position of the wheels. Relative to a normal floor coverage area width of approximately 75 cm, this is a considerable value that can significantly influence the stability.

The utilization of wheels or legs makes it possible to raise the lower edge of the base off the floor such that hospital personnel caring for the patient lying in the bed can stand as close to the bed as possible, because the front of their feet can be placed underneath the raised base. If the bed is equipped with wheels, two wheels need to be provided with brakes so as to ensure that the bed cannot roll away when in the chair position. The brakes should be arranged on the wheels that are situated distant from the foot section when in the chair position.

Depending on the design of the bed, one or more support legs may be utilized rigidly or movably. Rigid support legs are particularly used when the bed is essentially arranged in a stationary fashion. Movable support legs equipped with the above-mentioned wheels preferably are utilized on mobile beds, such as beds used, for example, in nursing homes and the like. The utilization of a movable support leg makes it possible to eliminate a stumbling hazard as would be created if the support leg is significantly elevated relative to the floor and laterally projects beyond the structure of the bed in the sleeping position.

When using rigid support legs, it is particularly advantageous for the free end of the support leg to end in a thin support plate. The support plate is only slightly elevated relative to the floor and does not represent a stumbling hazard, even if it always projects laterally beyond the structure of the bed.

The movable support leg is moved back into a position in which it only projects slightly, if at all, beyond the bed structure from a position in which it projects not only beyond the structure in the sleeping position, but preferably also beyond the structure defined by the bed frame in the chair configuration. This movement can be advantageously combined with a vertical movement such that the clearance space underneath the base is preserved in its entirety over the whole floor coverage area. This is important if it is intended that lifters should be able to extend beneath it.

When utilizing a movable support leg, it is advantageous for the free end of the support leg to be connected to a roller that enables the support leg to roll freely on the floor when it is moved from one end position to the other end position, and vice versa. The movable support leg preferably is provided with an articulation that is situated distant from the projecting end. It is preferred to arrange the articulation on the end of the support leg that is always situated directly on the base. The articulation may have one or two axes, depending on the design of the support leg and its travel path. In case an articulation is provided with two axes, one axis consists of a translatory axis and the other of a rotatory axis.

The articulation arrangement makes it possible to move the support leg along a path with at least one component that is aligned transverse to the longitudinal direction of the bed in the sleeping position. Such a travel path also is effected if the support leg needs to be turned about an axis at least approximately vertical in order to be moved from the idle or parking position into the supporting position.

An articulation arrangement with two axes may comprise, for example, two toothed racks that are arranged parallel to and spaced apart from one another. The two toothed racks are mounted on the base and mesh with corresponding pinion gears, with the pinion gears being rigidly connected to one another by means of a shaft on which the support leg is pivotably supported.

The retracted position of the support leg preferably is defined by a limit stop that operates outside the plane of a drive unit for moving the support leg upon engagement. This is effected in such a way that the support leg is automatically pivoted upward when it comes in contact with the limit stop.

A particularly stable arrangement is achieved if two support legs are provided and coupled to one another. A common articulation may be provided for both support legs in this case.

Hospital or nursing home personnel are able to approach the bed very closely if the base has at least one longitudinal edge that is spaced apart from the floor at least in a central region relative to the longitudinal direction of the rotating bed in the normal bed or sleeping position. Very stable conditions for the support leg are achieved if the support leg can be moved back and forth in the gap between the edge and the floor. In this case, the base forms an abutment for the support leg when it is situated in the supporting position.

Other objects and advantages of the invention will become apparent upon reading the following detailed description and upon reference to the drawings, in which:

Figure 1:
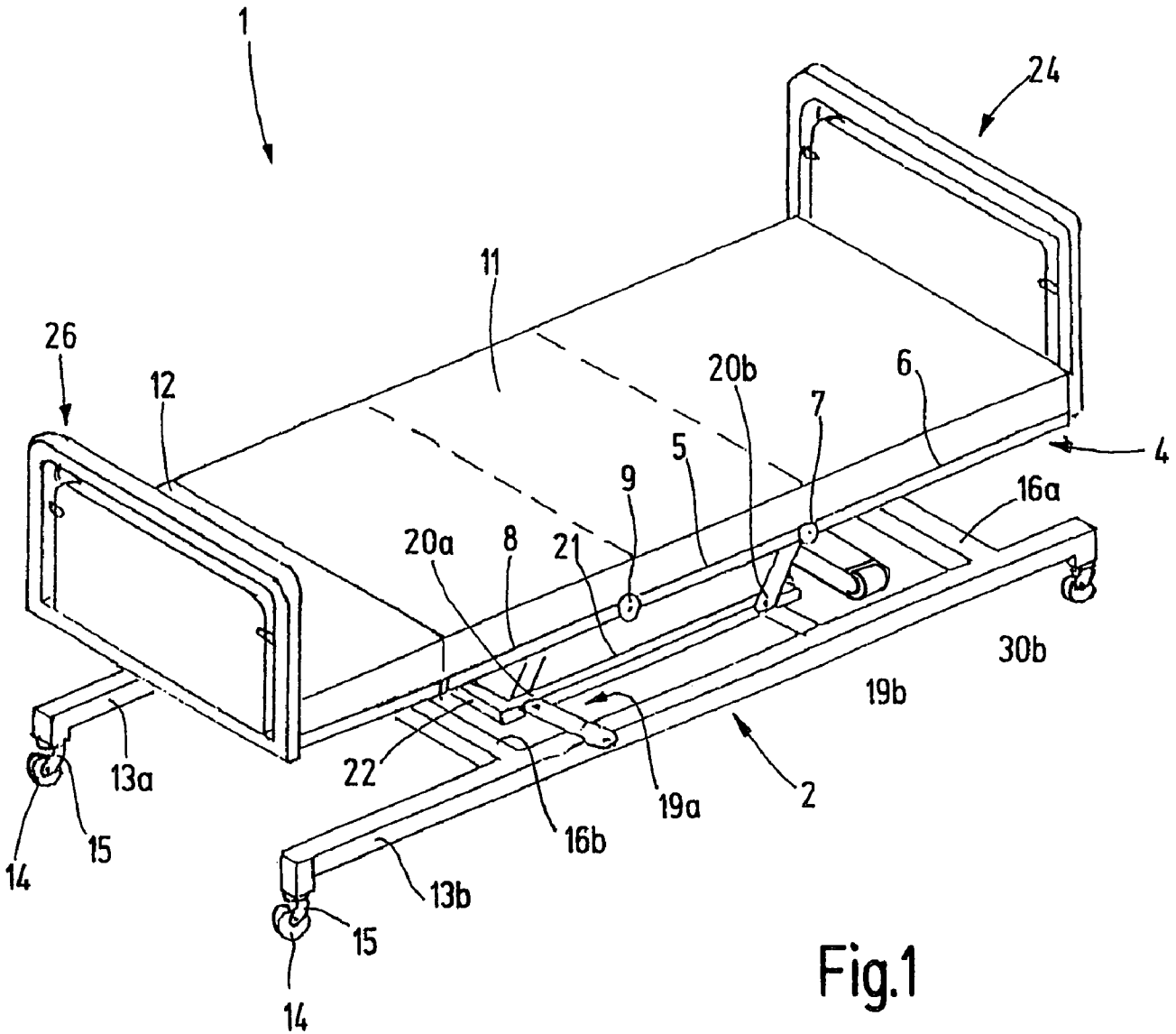
FIG. 1 is a perspective of a rotary hospital or nursing home bed in accordance with the invention, shown in the sleeping position.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Figure 2:
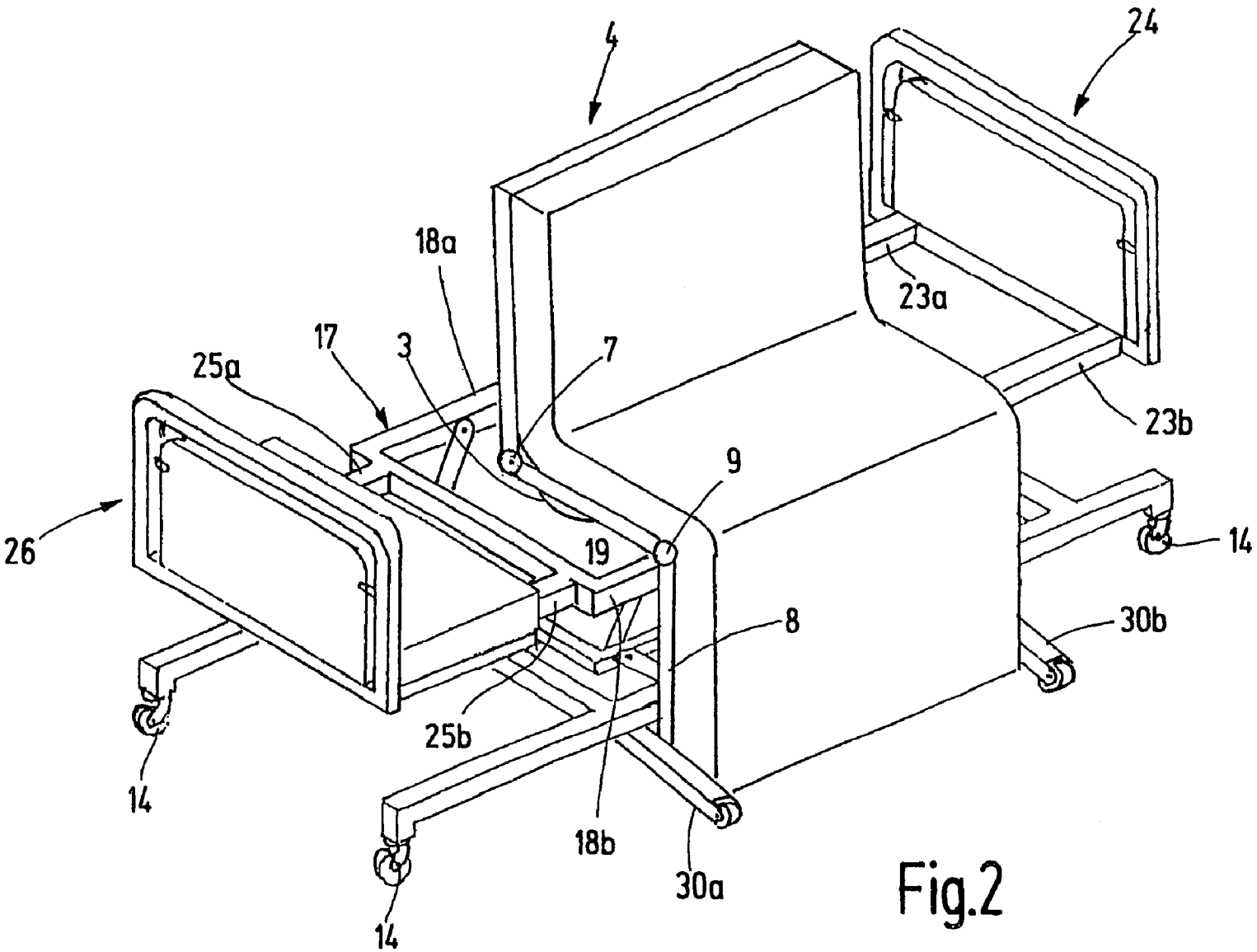
FIG. 2 is a perspective of the rotating bed shown in FIG. 1, after being rotated into the chair position.

Referring now more particularly to FIGS. 1 and 2 of the drawings there is shown an illustrated rotating bed 1 embodying the present invention that is particularly adapted for use in nursing homes or hospitals. The rotating bed basically comprises a height-adjustable base 2 that stands on the floor and carries a rotary mechanisms, as depicted in FIG. 2, at its upper end. A bed frame 4 is supported on the rotary mechanism 3 for rotational movement about a vertical axis of the rotary mechanism. The bed frame 4, of which only the longitudinal rails are visible in the respective figures, is divided into at least three sections.

A center or central section 5 of the bed frame 4 is directly connected to the upper end of the base 2 by means of the rotary mechanism 3. A back section is coupled to the upper end of the central section 5 with the aid of two hinges 7 that are aligned with one another and interconnect the rails of the respective sections. The two hinges 7 make it possible to pivot the back section 6 relative to the central section about a horizontal axis.

On the lower end of the central section 5, a lower leg section 8 is connected to the central section 5 by means of hinges 9. The hinges 9 make it possible to pivot the lower leg section 8 relative to the central section 5 about a horizontal axis.

In order to improve the sleeping comfort, the central section 5 may be additionally divided into an immovable section and a thigh section. This variation is not illustrated in the figures because it is not essential to an understanding of the invention.

A mattress 11 lies on the bed frame 4. The length of the mattress is adapted for configuration into a chair position as illustrated in FIG. 2, and is not sufficiently long for a normal bed. For this reason another essentially immovable mattress section 12 is used for extending the mattress 11.

The height-adjustable base 2 includes two longitudinal rails 13*a*, 13*b* that are aligned parallel to one another and to the longitudinal axis of the rotating bed 1 in the sleeping position illustrated in FIG. 1. Steerable wheels 14 are provided on the ends of the two longitudinal rails 13*a*, 13*b* which are rotatable about a vertical axis by means of steerable forks 15 supported in the respective longitudinal rails 13*a* and 13*b*.

It will be understood that points at which the wheels 14 are in contact with the floor represent the floor contact points and define a floor coverage area that is approximately rectangular. The deviation from the rectangular shape is caused by the steerability of the wheels 14. A more or less significant deviation from the rectangular shape occurs depending on the caster and the steering position of the wheels. The two longitudinal rails 13*a*, 13*b* in this instance are rigidly interconnected by means of two transverse rails 16*a*, 16*b*.

An upper end or portion of the illustrated base 2 is formed by a rectangular frame 17 that is composed of two parallel longitudinal rails 18*a*, 18*b*, as well as two transverse rails 19, only one of which is visible in the figure.

Four knee levers 19*a*, 19*b* are hinged to the two lower longitudinal rails 13*a*, 13*b*, with only the knee levers on the front side of the bed being seen in FIG. 1. Two additional knee levers are arranged in an axially parallel fashion on the other or rear side, in mirror image to knee levers shown in FIG. 1.

The knee levers 19*a*, 19*b* serve to connect the lower longitudinal rails 13*a*, 13*b* to the upper frame 17. In the region of their knee joints 20*a*, 20*b*, the knee levers 19*a*, 19*b* on each side of the bed 1 are respectively connected by means of a coupling rod 21. The two coupling rods 21 are interconnected by means of a connecting brace 22, wherein an appropriate lifting motor, not shown, engages with the connecting brace 22. Another obliquely extending connecting brace is omitted in the figures in order to provide a better overview. The basic design of the base is shown in DE 196 04 074, the disclosure of which is incorporated herein by reference.

Two braces 23*a*, 23*b* are connected to the end of the upper frame 17 on the side of the headboard. These braces serve to rigidly connect a headboard 24 to the base 2.

Two additional braces 25, 25*b* project from the end of the frame 17 on the side of the footboard. These braces carry a footboard 26 that is aligned parallel to the headboard 24. The two braces 25*a*, 25*b* also support the lower mattress section 12, if applicable, by means of an appropriate intermediate spring element.

The illustrated rotating bed 1 functions as described below:

In the normal sleeping position shown in FIG. 1, the mattress 11 extends in the longitudinal direction between the headboard and the footboard 24, 26, with the mattress contacting the headboard 24. A gap on the footboard end of the bed is filled by the mattress 12. In this sleeping position, the patient lying on the mattress 11, 12 can be selectively raised and lowered by adjusting the height of the base 2. This is necessary, for example, in order to move the patient to a height at which the nursing home or hospital personnel are able to comfortably perform required procedures on the patient. However, patents commonly find this height uncomfortable when no procedures are being performed. For this reason, the bed can also be lowered to a normal bed height. In addition, the back section 6 and/or the foot section 8 can be selectively pivoted upwardly from the sleeping position, with the aid of electric motors.

When the patient lying in the bed needs to be mobilized or wants to get out of bed despite physical disabilities, the bed can be converted from the position shown in FIG. 1 into the position shown in FIG. 2 by means of electric motors and a corresponding control unit. In such instances, the back section 6 is initially raised from the sleeping position shown in FIG. 1 until the back of the patient is in a comfortable upright position.

The lower leg section 8 is also raised. This results in two advantages. The patient senses a certain support in the resulting trough-like configuration of the mattress frame 4, and the bottom edge of the lower leg section 8 is raised to a height that lies above the upper edge of the mattress section 12. Once this position is reached, the mattress frame 4 can be rotated about the vertical axis with the aid of an electric motor, not shown, and the control unit. As viewed from the top of the illustrated bed, the mattress frame is turned in the counterclockwise direction until the foot section 8 projects over the left side of the bed. In this position, the axes of the hinges 7, 9 are aligned parallel to the longitudinal direction of the rotating bed 1. The foot section 8 can then be pivoted downward into the position shown in FIG. 2 with the aid of an electric motor. The back section 6, the central section 5 and the foot section 8 are then positioned such that the chair-like configuration results, as depicted in FIG. 2.

It can be seen that the external drives make it possible for the patient to convert the bed from the sleeping position to the sitting position without the assistance of the nursing home or hospital personnel. Once the sitting position is reached, the legs of the patient hang over the side of the bed and the patient is able to stand up. The length of the lower leg section 8 can be chosen accordingly.

Due to the design and the anatomy of the human body, in the chair position 2 the axis of the hinge 9, which is situated underneath the thighs and set back relative to the hollow of the knee, is positioned outside the floor coverage area defined by the wheels 14. In this respect, the edge of the floor coverage area that is defined by the wheels on the longitudinal rail 13*b* is of particular importance because this edge lies on the side on which the rotating bed 1 would tip over in the event of an overload. If one projects the axis of the hinges 9 on the floor and measures the distance from the flow coverage area, it becomes clear that this distance depends on the steering position of the wheels 14. If the wheels in FIG. 2 point in the direction of the observer, the shortest distance is measured and the highest stability is achieved. The stability is lower when the steering wheels point away from the observer and consequently depends on the random steering position of the wheels 14. This means that the stability could possibly reach its limit if heavy patients are awkwardly seated on the mattress frame in the chair position.

In carrying out the invention, in order to reliably prevent the bed from tipping over the longitudinal rail 13*b* two selectively extendible support legs 30*a*, 30*b* are provided. The two support legs and 30*a*, 30*b*, depicted in the extended position in FIG. 2, laterally project from the floor coverage area defined by the 4 wheels 14. They laterally encompass the foot section 8 that extends toward the floor and ensure that the tip-over edge of the bed is no longer defined by the wheels 14 on the longitudinal rail 13*b*, but rather by the free ends of the legs 30*a*, 30*b*. With these contact points lying beyond the projected axis of the hinges 9, it is impossible for the bed to tip over at this location, independently of the load. In this case, the stability limit cannot be exceeded, even if the nursing home or hospital personnel lean on the bed while it is turned.

The two support legs 30, 30*b* are only extended when needed, i.e., only in the chair position shown in FIG. 2. Otherwise, they would form a serious stumbling hazard. Hence, the support legs are retractable between the two rails 13*a*, 13*b* and raised off the floor when the bed is in the sleeping position shown in FIG. 1. For reasons of simplicity, only part of the support leg 30*b* is illustrated in FIG. 1 and the other support leg 30*a* is not shown in the figure because this would unnecessarily complicate the figure.

Figure 3:
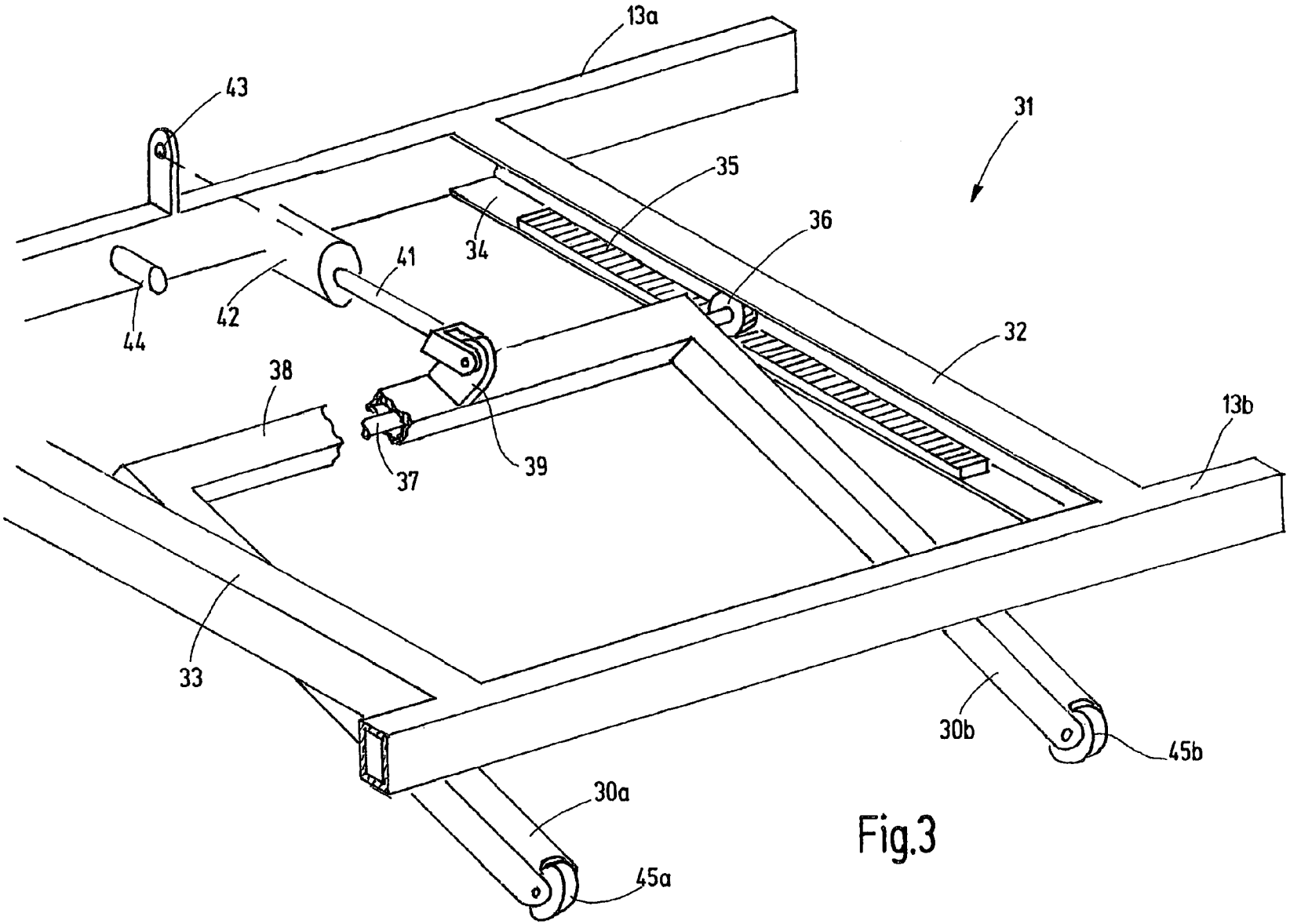
FIG. 3 is an enlarged perspective of an articulation arrangement for guiding and moving support legs for the bed into supporting position when the bed is in a chair position.

A support arrangement 31, shown in FIG. 3, in this case is provided for connecting the support legs 30, 30*b* to the base 2. The support arrangement 31 includes two crossbeams 32, 33, the ends of which are connected to the longitudinal rails 13*a*, 13*b* in perpendicular relation to the longitudinal rails 13*a*, 13*b*. Both crossbeams 32, 33 have a C-shaped profile and are open on the sides that face one another. On their lower legs 34 of the cross beams, a toothed rack 35 is respectively provided such that it extends in the longitudinal direction of the crossbeams 32, 33. Due to the oblique view, only the closed back of the crossbeam 33 is visible in this figure. If this arrangement were viewed from the opposite side, this crossbeam 33 would represent a mirror image of the crossbeam 32 shown.

A pinion gear 36 meshes with the toothed rack 35 and a corresponding pinion gear meshes with the toothed rack provided in the crossbeam 33. The two pinion gears 36 are connected to one another in rotationally fixed fashion by means of a shaft 37 that lies parallel to the longitudinal rails 13*a*, 13*b*. The shaft 37 extends through a tubular connecting brace 38 that rigidly interconnects the inner ends of the two support legs 30*a*, 30*b* that are aligned parallel to one another and are in the form of straight square tubes. A bracket 39 projects upwardly approximately in the center of the connecting brace 38 and is coupled to an actuating rod 41 of a driving motor 42. The other end of the motor 42 is anchored on a bracket 43 mounted on the longitudinal rail 13*a*. In addition, a limit top 44 projects from the inner side of the longitudinal rail 13*a* in a direction toward the opposite longitudinal rail 13*b*.

The support arrangement 31 cooperates with the driving motor 42 as described below:

FIG. 3 shows the support legs 30*a*, 30*b* in an intermediate position between the completely extended position in which the support legs 30*a*, 30*b* are in the supporting position and a parking position in which they are retracted between the two longitudinal rails 13*a*, 13*b* and raised off the floor.

When the support legs 30*a* and 30*b* need to be moved into the parking position from the position shown in FIG. 3, the driving motor 42 retracts the actuating rod 41 in the direction of the longitudinal rail 13*a*. During this process, the rear ends of the support legs that are supported on the shaft 37 move in a direction toward the longitudinal rail 13*a*, wherein the pinion gears 36 act as wheels. Since the pinion gears mesh with the toothed racks 35, the movements relative to the crossbeams 32, 33 are synchronized, and they are prevented from becoming jammed.

The connecting brace 38 comes in contact with the limit stop 44 when the free ends of the support legs 30*a*, 30*b* are retracted behind the structure of the longitudinal rail 13*b*. Since this contact point lies lower than the point at which the actuating rod 41 engages with the bracket 39, a torque is generated about the shaft 37 such that the support legs 30*a*, 30*b* are raised off the floor.

The driving motor 32 is switched off when both support legs 30*a*, 30*b* are raised to such a degree that their free ends no longer project downwardly beyond a plane that is defined by the underside of the two longitudinal rails 13*a*, 13*b*. This position represents the parking position. In this position, appropriate lifting devices can be easily placed underneath the two longitudinal rails 13*a*, 13*b*. In addition, personnel caring for the patient are not at risk of colliding with parts that project underneath the longitudinal rails 13*a*, 13*b*.

When the two support legs 30*a* and 30*b* need to be extended, the driving motor 42 is actuated in the opposite direction. Due to their own weight, the support legs 30*a*, 30*b* are initially pivoted downward until their free ends are in contact with the floor. Two rollers 45*a*, 45*b* that are rotatable about horizontal axes relative to the floor are provided on the free ends of the support legs 30*a*, 30*b* in order to prevent the floor from being damaged during the additional extension of the support legs. The axes of rotation of the aforementioned rollers lie perpendicular to the travel direction of the support legs 30*a*, 30*b* during their extension.

The weight the support legs 30*a*, 30*b* initially cause the support legs to come in contact with the floor, wherein the support legs are subsequently extended laterally, relative to the bed, underneath the rail 13*b*. Since the contact force on the floor is defined by the weight of the support legs 30*a*, 30*b*, there is no risk of crushing or otherwise injuring someone whose feet are positioned in the travel path of the support legs 30, 30*b*. The forward movement does not cease until both support legs 30*a*, 30*b* come in contact with the bottom of the longitudinal rail 13*b* with their upper side which faces the observer. Any jamming of the support legs during their movement is prevented by means of the pinion gears 36 that are coupled to one another in a rotationally fixed fashion and cooperate with the stationary toothed racks 35.

The motor 42 is switched off as soon as the support legs reach the above-described position, i.e., the supporting position. Both support legs 30*a*, 30*b* are now fixed underneath the rail 13*b* such that a three-point support is achieved for each rail. Each rail that is in contact with the floor by means of its roller 45 adjoins the adjacent lower edge of the longitudinal rail 13*b* a certain distance from the roller 45 and is supported on the respective crossbeam 32 or 33 a certain distance from this contact point at its end that is situated in the base 4, namely with the aid of the shaft 37 and the pinion gear 36. In the described supporting position, both support legs 30*a*, 30*b* project beyond the floor coverage area of the rotating bed 1 in any pivoting or longitudinal position of the wheels 14.

Figure 4:
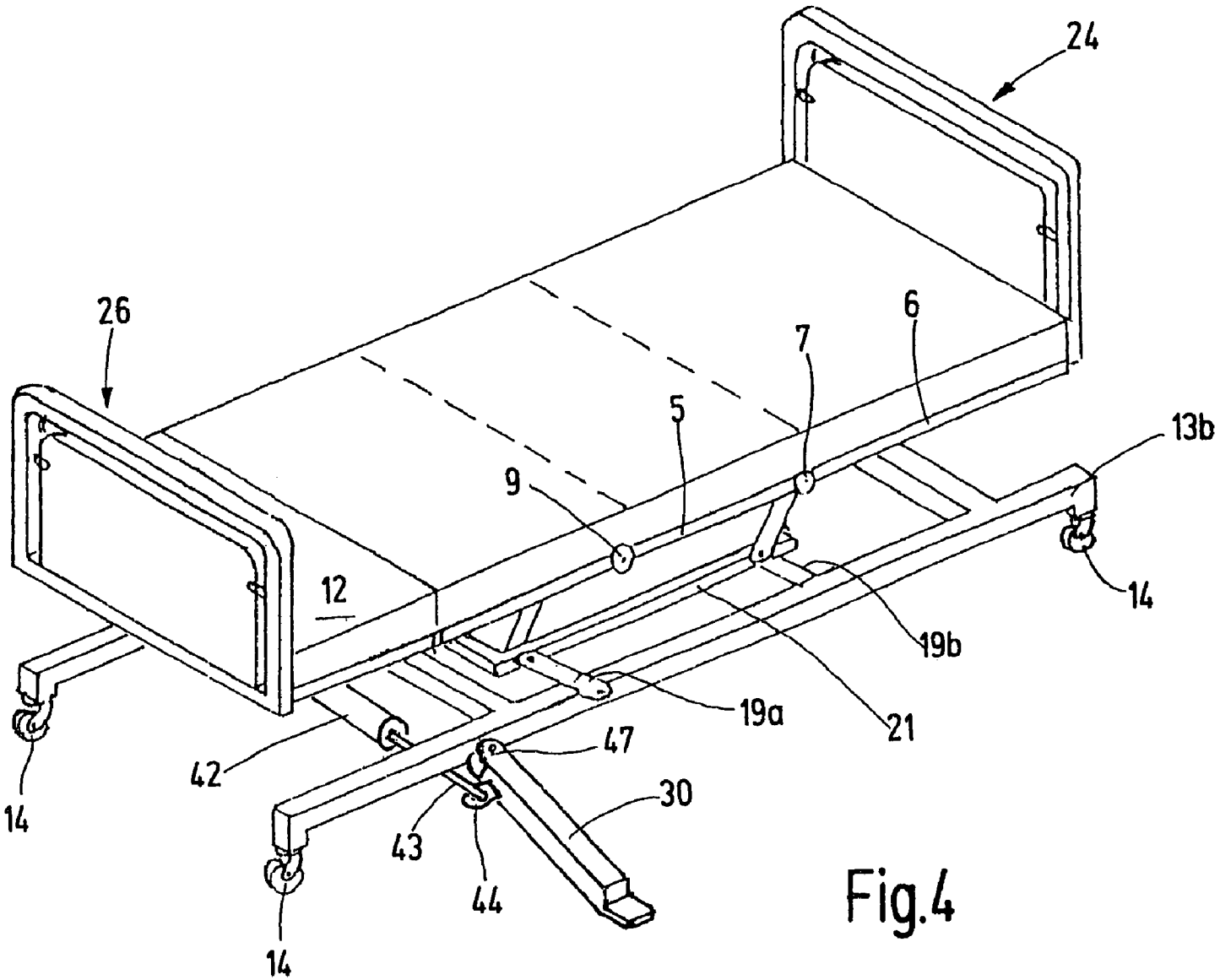
FIG. 4 is a perspective of an alternative embodiment of rotating bed in accordance with the invention, having a single pivotal support leg.

FIG. 4 shows an embodiment of the rotating bed 1 that utilizes only one support leg 30. With the exception of the design and the coupling arrangement of the support leg 30, the bed 1 is similar to that shown in FIGS. 1 and 2. Consequently, the following description is limited to the design of the support leg 30 and its coupling arrangement.

The support leg 30 in this case, as depicted in FIG. 4, is hinged to the outer side of the longitudinal rail 13*b*. The hinge point is situated toward the foot side of the bed, such that a patient who sits on the bed in the chair position according to FIG. 2 while the support leg 30 is extended would see the support leg 30 adjacent to the right side of the lower leg section 8. In the parking position, the support leg 30 is pivoted by 90° and extends parallel to the rail 13*b*, with its free end being simultaneously raised off the floor. The support leg 30 can be pivoted with the aid of the driving motor 32 that is connected by means of an actuating rod 43 to a bracket 44 projecting from the support leg 30.

Figure 5:
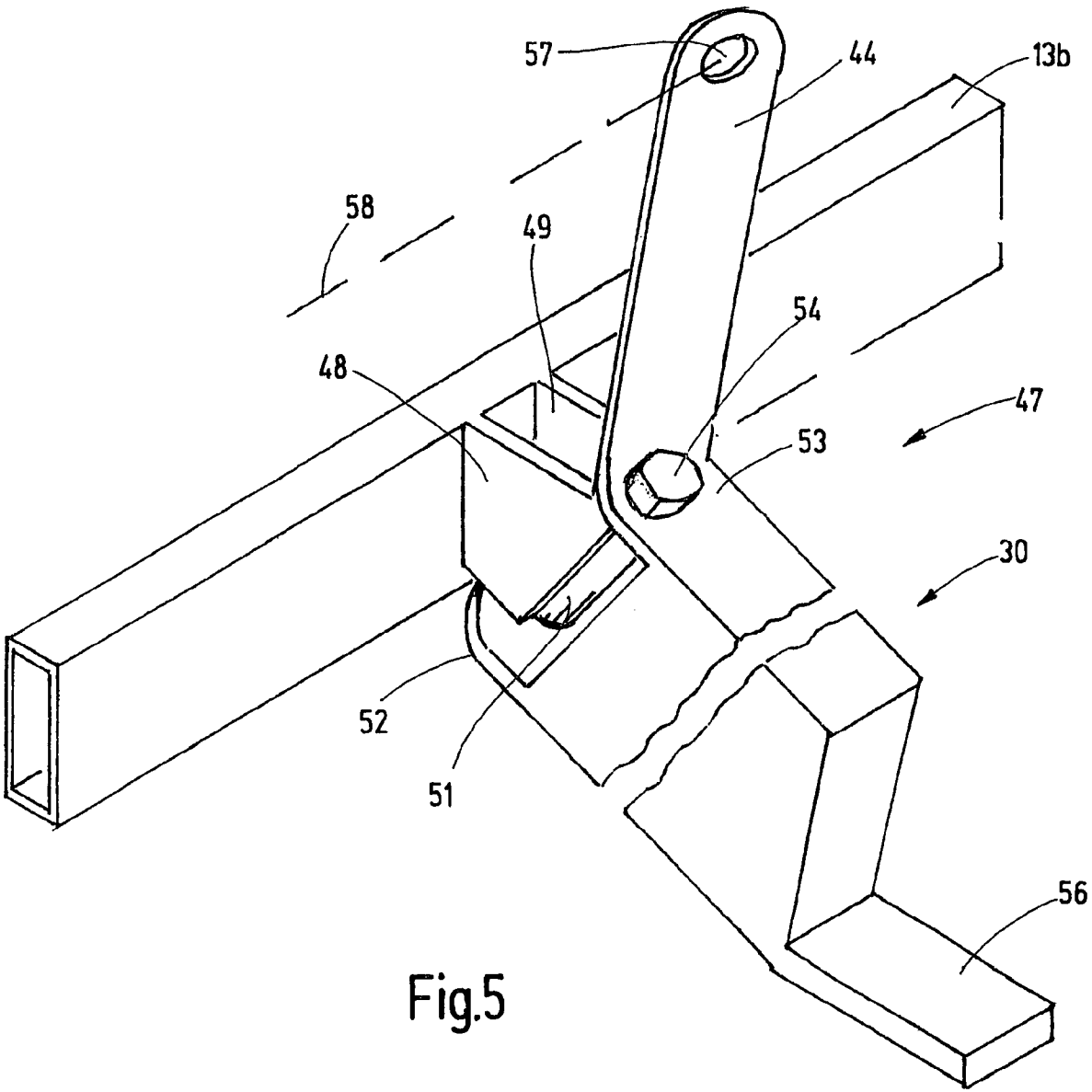
FIG. 5 is an enlarged perspective of the support leg coupling for the rotating bed shown in FIG. 4.

In the supporting position, the support leg 30 extends transversely downward from its coupling point 47. In the parking position, the support leg lies parallel to the longitudinal rail 13*b*. This is achieved with a coupling point 47, as shown in FIGS. 5 and 6.

Two upwardly projecting brackets 48, 49 are welded to the outer side of the longitudinal rail 13*b*, with a bearing bushing 51 being fixed to the free ends of the brackets. The bearing bushing 51 has a cylindrical bore not visible in the figures, with an axis, in a vertical plane aligned perpendicular to the longitudinal axis of the rotating bed 1, i.e., perpendicular to the longitudinal axis of the longitudinal rail 13*b*. The bore axis is inclined in this imaginary plane such that it points away from the bed at the top and toward the bed at the bottom. In one practical embodiment, the angle of inclination of the axis of the bore of the bearing bushing 51 lies at about 22° relative to the vertical line. However, this angle depends on the height of the longitudinal rail 13*b* relative to the floor and the required projecting length of the support leg 30.

Figure 6:
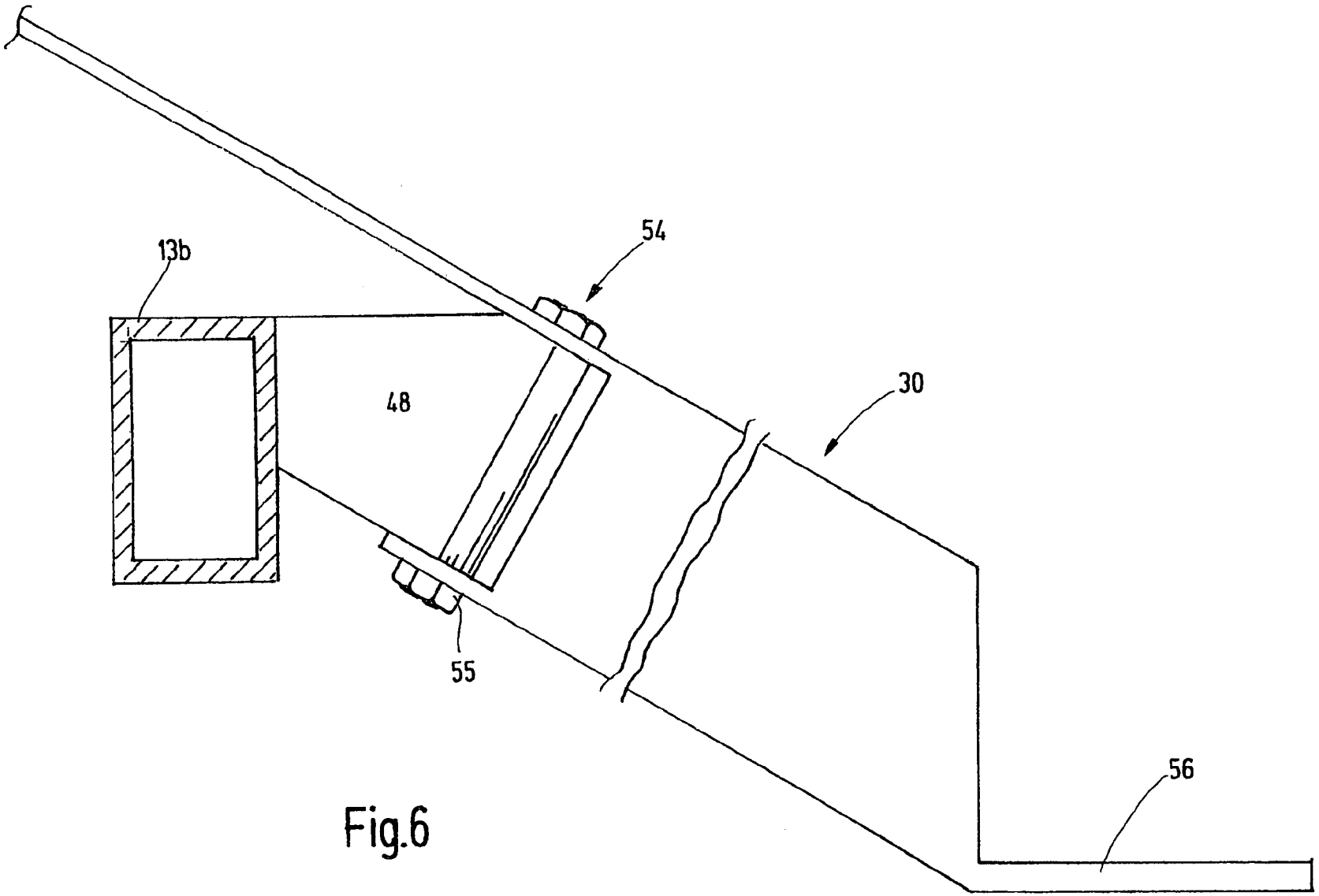
FIG. 6 is a vertical section, depicting a side elevational of the support leg coupling shown in FIG. 5.

On the end of the support leg 30 on the side of the bed two parallel flanges 52, 53 are provided that cover the ends of the bearing bushing 51, as shown in FIG. 6, i.e., the bearing bushing 51 extends between the two flanges 52, 53 with a slight axial clearance. A hinge bolt 54 in the form of a cap screw extends through bores that are aligned with one another, with a nut 55 being threaded onto the downwardly projecting threaded end of the cap screw.

The projecting end of the support leg 30 is provided with a support plate 56. In the embodiment shown in FIGS. 5 and 6, the actuating tongue 44 is integral with the upper flange 53 and projects over the longitudinal rail 13*b* into the interior of the base 2. An actuating rod that is symbolized by a broken line 58 engages with a mounting hole 57. This actuating rod essentially extends parallel to the longitudinal rail 13*b* and connects the actuating tongue 44 to a motor, not shown.

When viewing the supporting position shown in FIGS. 5 and 6 from the top, the support leg 30 projects perpendicular to the longitudinal rails 13*b*. The underside of its support plate 56 may be in contact with the floor. However, the underside of the support plate preferably is spaced slightly above the floor by about 5 mm. In order to retract the support leg 30, it is turned about the hinge bolt 54 in the counter-clockwise direction, as viewed in FIG. 5. During this process, the support plate 56 moves from the floor in the direction of the rail 13*b* along an inclined circular path. During this pivoting movement, the support plate 56 is simultaneously moved from the floor to a position above the underside of the longitudinal rail 13*b*. Due to these measures, no parts of the base 2 project downwardly beyond the lower edge of the longitudinal rails 13 so that the leg room is preserved over the entire area.

In the embodiment in FIGS. 1–3, it was assumed that the support legs 30*a*, 30*b* contact the floor with a certain initial stress. The support leg 30 in the embodiment shown in FIGS. 4–6 is spaced slightly apart from the floor. This means that the tip-over line is initially defined by the connecting line between the corresponding adjacent wheels 14 that extends directly behind the foot section 8. If the stability limit is exceeded due to an awkward load, the bed slightly tips over along this line, namely until the support leg 30 contacts the floor. The tip-over line is now defined by the connecting line between the floor contact point of the support leg 30 and the adjacent wheel 14 situated closest to the headboard end. This straight line lies much closer to the axis of the hinges 9, such that an improved stability is achieved after the support leg 30 becomes effective. Since the stability normally suffices and is exceeded only in special instances, it is advantageous for the support leg 30 to initially be positioned slightly above the floor in the supporting position. In that case, the pivoting of the support leg 30 between the parking position and the supporting position does not produce any marks on the floor. This is particularly advantageous on soft floors. In addition, the support leg 30 can be made weaker in the embodiment with a floating support leg since it needs to absorb only the additional tip-over force. In this case, the base and the remainder of the bed act as a counterweight and alleviate the support leg 30. Significantly higher forces can be supported, namely also in normal instances, in the embodiment according to FIG. 3, in which the support legs 30*a*, 30*b* contact the floor with an initial stress from the beginning.

Figure 7:
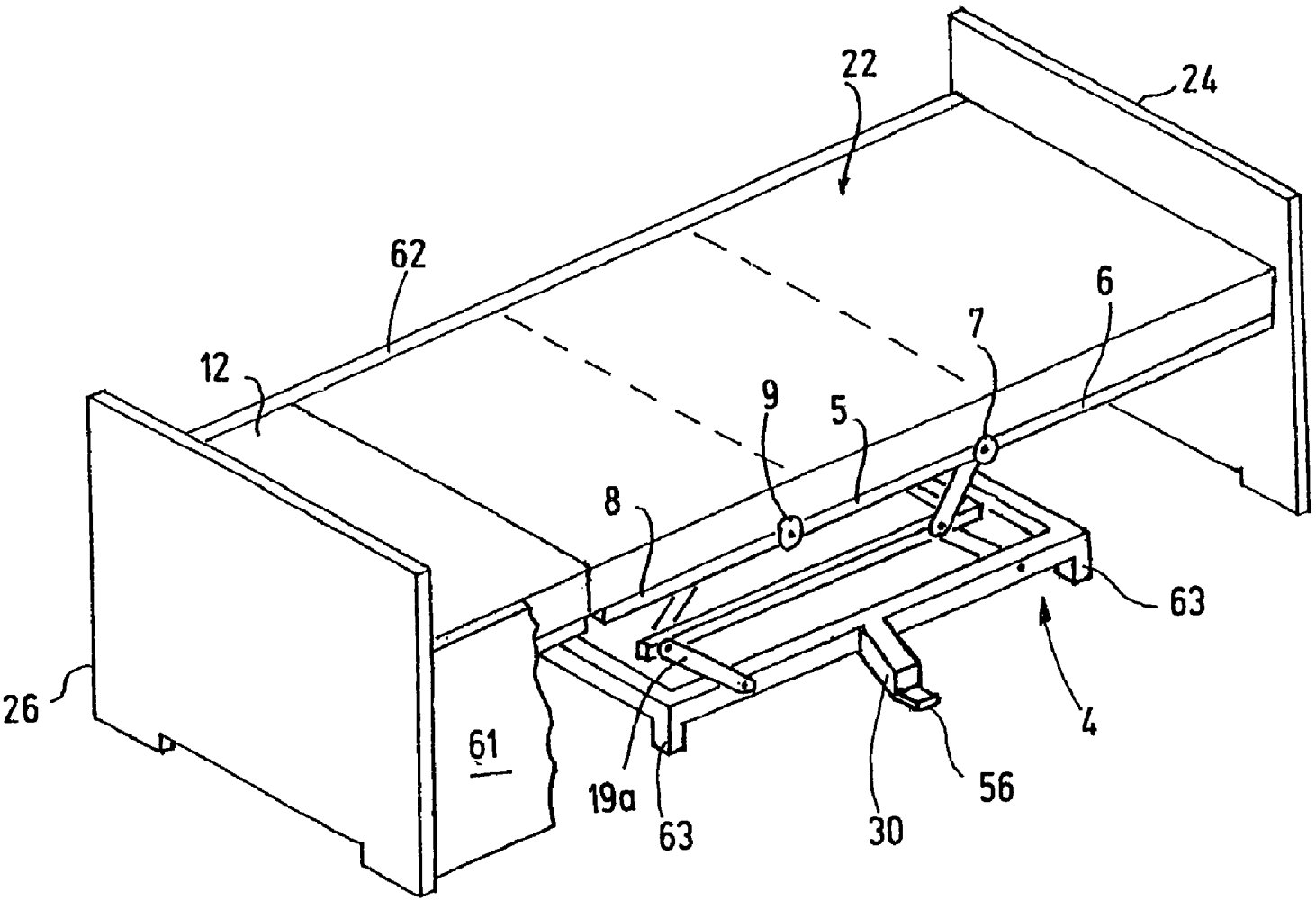
FIG. 7 is a perspective of a rotating bed in accordance with the invention having an alternative immovable support leg.

FIG. 7 shows an embodiment of the rotating bed 1 that also is suitable for home care use. The essential difference can be seen in the utilization of an outer bed frame, wherein the headboard and the footboard 24, 25 are placed directly on the floor and are connected to one another by sideboards 61, 62. The base 4 stands stationarily on legs 63 in the thus-defined rectangular space, with the longitudinal rails 13 being reduced to the length of the longitudinal rails of the upper frame 17. The mattress section 12 is fixed within the bed frame independently of the base 4. In order to provide the base 4 with the highest stability possible, an additional rigid support leg 30 is mounted directly on the longitudinal rail 13*a*. This support leg laterally projects as far as possible over the floor coverage area defined by the legs 63, with the support plate 56 of the support leg projecting outward, if applicable, under the sideboard 61.

A rotating bed has a base for supporting an articulated mattress frame such that it can be rotated about a vertical axis. In one rotational position, the mattress frame can be converted into a chair-like configuration. In order to improve the stability of the arrangement in the chair position, at least one support leg is provided that, in the supporting position, either contacts the floor from the beginning or only makes contact with the floor when the stability limit without the support leg is exceeded.

The invention claimed is:

1. A rotating bed (1) that can be converted from a normal sleeping position into a chair position comprising, a base (2) positionable on the floor for defining a longitudinally extending floor coverage area;

a mattress frame (4) comprising three mattress frame sections (5, 6, 8), said mattress frame sections including a central mattress frame section (5) and two other mattress frame sections (6, 8), said two other mattress sections (6, 8) each being hinged to respective opposite ends of said central mattress frame section (5) for pivotal movement about horizontal axis in order to enable displacing of the mattress frame (4) from a sleeping position into a chair position;

a rotary joint (3) having a vertical axis of rotation for rotatably supporting the central mattress frame section (5) on said base for movement about said vertical axis;

at least one support leg (30) supported by said base for movement between a retracted rest position and an extended position projecting outwardly from the floor coverage area in a direction substantially perpendicular to a longitudinal side of the bed when in a normal sleeping position for providing additional stability, to the rotating bed when in the chair position; and a drive operable by a person in the rotatable bed for automatically moving the least one support leg (30) between said retracted and extended positions.

2. The rotating bed of claim 1 in which said base has a plurality of contact points with the floor that defined the floor coverage area.

3. The rotating bed of claim 2 in which said base has four contact points with the floor which define the corners of an approximately rectangular floor coverage area.

4. The rotating bed of claim 2 in which said base has four stationary legs that form said contacts points with the floor.

5. The rotating bed of claim 2 in which said base has four wheels (14) that are rotatable about horizontal axis and form said contact points with the floor.

6. The rotating bed of claim 5 in which said wheels further are rotatable about vertical axis relative to the base (2).

7. The rotating bed of claim 5 in which said wheels are supported by respective forks (15) for rotational movement about horizontal axis, and said forks (15) each are connected to the base for relative rotation about a vertical axis.

8. The rotating bed of claim 5 in which at least one of said wheels (14) has selectively engageable and disengageable brake.

9. The rotating bed of claim 1 including a motor for adjustably moving the other mattress sections (6, 8) relative to the central mattress section (5).

10. The rotating bed of claim 1 in which said support leg (30) has a plate (30) on an outer projecting end thereof, said plate being aligned parallel to the floor when the support leg is in a position for providing additional stability of the rotating bed when in the chair position.

11. The rotating bed of claim 1 in which said support leg (30) is rigidly mounted on said base (2).

12. The rotating bed of claim 1 in which said support leg (30) is rotatably connected to the base (2) for movement between a supporting position in which it projects outwardly beyond the boundaries of said floor coverage area and a parking position in which the support leg is retracted and does not substantially project from the structure of the mattress frame (4) when in a sleeping position.

13. The rotating bed of claim 12 in which said support leg (30) is moveable between a lowered position in the immediate vicinity of the floor and a raised position in which it is spaced from the floor a greater distance than when in said lowered position.

14. The rotating bed of claim 12 in which said support leg (30) includes an articulation, (31, 47) at a point distant from a projecting end of the support leg.

15. The rotating bed of claim 14 in which said articulation joint (31,47) supports the support leg (30) for movement along a path in which at least one component of movement is for at least a certain distance transverse to the longitudinal direction of the bed when in the sleeping position.

16. The rotating bed of claim 14 in which said articulation joint (31, 47) is provided at one end of the support leg (30).

17. The rotating bed of claim 14 in which said articulation joint (31, 47) has at least one axis.

18. The rotating bed of claim 17 in which at least one axis is a translatory axis.

19. The rotating bed of claim 17 in which said at least one axis is a rotary axis.

20. The rotating bed of claim 14 in which said articulation (31) joint supports the support leg (30) for pivotal movement about a horizontal axis.

21. The rotating bed of claim 1 in which said base (1) has at least one longitudinally extending edge (13) that is spaced above the floor at least in a central region when the rotating bed is in the sleeping position.

22. The rotating bed of claim 21 in which said support leg can be moved within a space between said longitudinal edge (13) of the base (1) and the floor between a lowered supporting position and a raised parking position.

23. The rotating bed of claim 22 in which said longitudinal edge (13) of said base forms an abutment for the support leg when in its supporting position.

24. The rotating bed of claim 22 in which said support leg (30) is rotatably supported along said longitudinal edge of said base (2).

25. A rotating bed (1) that can be converted from a normal sleeping position into a chair position comprising, a base (2) positionable on the floor for defining a longitudinally extending floor coverage area;

a mattress frame (4) comprising three mattress frame sections (5, 6, 8), said mattress frame sections including a central mattress frame section (5) and two other mattress frame sections (6, 8), said two other mattress sections (6, 8) each being hinged to respective opposite ends of said central mattress frame section (5) for pivotal movement about horizontal axis in order to enable displacing of the mattress frame (4) from a sleeping position into a chair position;

a rotary joint (3) having a vertical axis of rotation for rotatably supporting the central mattress frame section (5) on said base for movement about said vertical axis;

at least one support leg (30) supported by said base projecting outwardly from the floor coverage area in a direction substantially perpendicular to a longitudinal side of the bed when in a normal sleeping position for providing additional stability to the rotating bed when in the chair position, and said support leg (30) having a roller (45) on an outer projecting end thereof rotatable about an axis parallel to the floor.

26. A rotating bed (1) that can be converted from a normal sleeping position into a chair position comprising, a base (2) positionable on the floor for defining a longitudinally extending floor coverage area;

a mattress frame (4) comprising three mattress frame sections (5, 6, 8), said mattress frame sections including a central mattress frame section (5) and two other mattress frame sections (6, 8), said two other mattress sections (6, 8) each being hinged to respective opposite ends of said central mattress frame section (5) for pivotal movement about horizontal axis in order to enable displacing of the mattress frame (4) from a sleeping position into a chair position;

a rotary joint (3) having a vertical axis of rotation for rotatably supporting the central mattress frame section (5) on said base for movement about said vertical axis;

at least one support leg (30) supported by said base projecting outwardly from the floor coverage area in a direction substantially perpendicular to a longitudinal side of the bed when in a normal sleeping position for providing additional stability to the rotating bed when in the chair position;

said support leg (30) being rotatably connected to said base (2) by an articulation joint (31, 47) at a point distant from a projecting end of the support leg for movement between a supporting position in which it projects outwardly beyond the boundaries of said floor coverage area and a parking position in which the support leg is retracted and does not substantially project from the structure of the mattress frame (4) when in a sleeping position;

said articulation joint (31) including two parallel toothed racks (35) that are mounted on said base (2) in laterally apart relation to each other and two pinion gears (36) that respectively mesh with the toothed racks (35), and said pinions gears (36) being connected by a shaft (37) on which said support leg (30) is pivotably supported.

27. The rotating bed of claim 26 including a limit stop (12) against which said support leg (30) engages upon being pivoted upwardly to said parking position.

28. The rotating bed of claim 26 including two of said support legs (30), said support legs (30) being connected to each other and supported on said shaft (37).

29. A rotating bed (1) that can be converted from a normal sleeping position into a chair position comprising, a base (2) positionable on the floor for defining a longitudinally extending floor coverage area;

a mattress frame (4) comprising three mattress frame sections (5, 6, 8), said mattress frame sections including a central mattress frame section (5) and two other mattress frame sections (6, 8), said two other mattress sections (6, 8) each being hinged to respective opposite ends of said central mattress frame section (5) for pivotal movement about horizontal axis in order to enable displacing of the mattress frame (4) from a sleeping position into a chair position;

a rotary joint (3) having a vertical axis of rotation for rotatably supporting the central mattress frame section (5) on said base for movement about said vertical axis;

and a pair of support legs (30) connected to each other and supported by said base projecting outwardly from the floor coverage area in a direction substantially perpendicular to a longitudinal side of the bed when in a normal sleeping position for providing additional stability to the rotating bed when in the chair position.

30. The rotating bed of claim 29 including a common articulation link (31) connecting said support legs (30) to said base (2).

31. A rotating bed (1) that can be converted from a normal sleeping position into a chair position comprising, a base (2) positionable on the floor for defining a longitudinally extending floor coverage area;

a mattress frame (4) comprising three mattress frame sections (5, 6, 8), said mattress frame sections including a central mattress frame section (5) and two other mattress frame sections (6, 8), said two other mattress sections (6, 8) each being hinged to respective opposite ends of said central mattress frame section (5) for pivotal movement about horizontal axis in order to enable displacing of the mattress frame (4) from a sleeping position into a chair position;

a rotary joint (3) having a vertical axis of rotation for rotatably supporting the central mattress frame section (5) on said base for movement about said vertical axis;

at least one support leg (30) supported by said base projecting outwardly from the floor coverage area in a direction substantially perpendicular to a longitudinal side of the bed when in a normal sleeping position for providing additional stability to the rotating bed when in the chair position;

said support leg (30) being rotatably connected to said base (2) by an articulation joint (31, 47) at a point distant from a projecting end of the support leg for movement between a supporting position in which it projects outwardly beyond the boundaries of said floor coverage area and a parking position in which the support leg is retracted and does not substantially project from the structure of the mattress frame (4) when in a sleeping position; and said articulation joint (47) having a single pivot axis in a vertical plane.

32. The rotating bed of claim 31 in which said pivotal axis is inclined in a vertical plane such that it extends outwardly and above the rotary bed (1).

33. A rotating bed (1) that can be converted from a normal sleeping position into a chair position comprising, a base (2) positionable on the floor for defining a longitudinally extending floor coverage area;

a mattress frame (4) comprising three mattress frame sections (5, 6, 8), said mattress frame sections including a central mattress frame section (5) and two other mattress frame sections (6, 8), said two other mattress sections (6, 8) each being hinged to respective opposite ends of said central mattress frame section (5) for pivotal movement about horizontal axis in order to enable displacing of the mattress frame (4) from a sleeping position into a chair position;

a rotary joint (3) having a vertical axis of rotation for rotatably supporting the central mattress frame section (5) on said base for movement about said vertical axis;

at least one support leg (30) supported by said base projecting outwardly from the floor coverage area in a direction substantially perpendicular to a longitudinal side of the bed when in a normal sleeping position for providing additional stability to the rotating bed when in the chair position;

said support leg (30) being rotatably connected to said base (2) by an articulation joint (31, 47) at a point distant from a projecting end of the support leg for movement between a supporting position in which it projects outwardly beyond the boundaries of said floor coverage area and a parking position in which the support leg is retracted and does not substantially project from the structure of the mattress frame (4) when in a sleeping position; and said support leg (30) being aligned parallel to the longitudinal direction of said rotating bed (1) when in said parking position.

* * * * *